US009605670B2

(12) United States Patent
Singal et al.

(10) Patent No.: US 9,605,670 B2
(45) Date of Patent: Mar. 28, 2017

(54) METHOD AND SYSTEMS FOR ENHANCING FLOW OF A FLUID INDUCED BY A ROD PUMPING UNIT

(71) Applicant: General Electric Company, Schenectady, NY (US)

(72) Inventors: Kalpesh Singal, Glenville, NY (US); Fatemeh Zamanian, Humble, TX (US); Egidio Marotta, Houston, TX (US); Shyam Sivaramakrishnan, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 161 days.

(21) Appl. No.: 14/575,789

(22) Filed: Dec. 18, 2014

(65) Prior Publication Data

US 2016/0177940 A1 Jun. 23, 2016

(51) Int. Cl.

| | |
|---|---|
| ***F04B 49/12*** | (2006.01) |
| ***F04B 51/00*** | (2006.01) |
| ***E21B 43/12*** | (2006.01) |
| ***F04B 47/02*** | (2006.01) |
| ***F04B 49/00*** | (2006.01) |

(52) U.S. Cl.

CPC ..... *F04B 49/12* (2013.01); *E21B 43/127* (2013.01); *F04B 47/02* (2013.01); *F04B 49/00* (2013.01); *F04B 51/00* (2013.01)

(58) Field of Classification Search

CPC ..... F04B 49/12

See application file for complete search history.

(56) References Cited

U.S. PATENT DOCUMENTS

| | | | |
|---|---|---|---|
| 4,102,394 | A | 7/1978 | Botts |
| 5,481,873 | A | 1/1996 | Saruwatari et al. |

(Continued)

FOREIGN PATENT DOCUMENTS

| | | | |
|---|---|---|---|
| WO | 9321442 | A1 | 10/1993 |
| WO | 2007041823 | A1 | 4/2007 |
| WO | 2013070979 | A2 | 5/2013 |

OTHER PUBLICATIONS

Gibbs, S. G.: "Predicting the Behavior of a Sucker Rod Pumping System," SPE of AIME, paper No. 588, Denver, Colo., (May 1963).*

(Continued)

*Primary Examiner* — Kenneth M Lo
*Assistant Examiner* — David Wynne
(74) *Attorney, Agent, or Firm* — Armstrong Teasdale LLP

(57) ABSTRACT

A system for enhancing a flow of a fluid induced by a rod pumping unit is provided. A pumping control unit is configured to control stroke movement of the rod pumping unit. The pumping control unit is configured to store a first set of stroke timing data based on a first pressure level and a second set of stroke timing data based on a second pressure level, store a set of pressure weights, and receive a current pressure level. The current pressure level is between the first pressure level and the second pressure level. The pumping control unit is also configured to determine a current set of stroke timing data based on the current pressure level, the first set of stroke timing, the second set of stroke timing, and the set of pressure weights, and initiate at least one stroke of the rod pumping unit.

21 Claims, 9 Drawing Sheets

(56) References Cited

U.S. PATENT DOCUMENTS

| | | | | |
|---|---|---|---|---|
| 6,343,656 | B1 * | 2/2002 | Vazquez | E21B 47/0008 166/373 |
| 6,890,156 | B2 | 5/2005 | Watson et al. | |
| 7,530,799 | B2 | 5/2009 | Smith et al. | |
| 8,444,393 | B2 | 5/2013 | Beck et al. | |
| 8,668,475 | B2 | 3/2014 | Gregory et al. | |
| 8,844,626 | B1 | 9/2014 | Krug | |
| 8,851,860 | B1 | 10/2014 | Mail | |
| 2004/0084179 | A1 | 5/2004 | Watson et al. | |
| 2008/0240930 | A1 * | 10/2008 | Palka | E21B 43/127 417/42 |
| 2011/0103974 | A1 | 5/2011 | Lamascus et al. | |
| 2012/0205119 | A1 | 8/2012 | Wentworth et al. | |
| 2012/0251335 | A1 | 10/2012 | Hurst et al. | |
| 2013/0151216 | A1 | 6/2013 | Palka et al. | |
| 2013/0306326 | A1 * | 11/2013 | Doyle | E21B 43/127 166/369 |

OTHER PUBLICATIONS

PCT Search Report and Written Opinion issued in connection with Corresponding Application No. PCT/US2015/063361 on Mar. 31, 2016.

Palka Krzysztof et al.; Optimizing Downhole Fluid Production of Sucker-Rod Pumps with Variable Motor Speed; SPE Production & Operations; May 2009; pp. 346-352.

Liu, Xinfu et al.; An Approach to the Optimum Design of Sucker-Rod Pumping System; ICIE 2010 Proceedings of the 2010 WASE International Conference on Information Engineering; Aug. 14-15, 2010; vol. 03; pp. 140-143.

* cited by examiner

METHOD AND SYSTEMS FOR ENHANCING FLOW OF A FLUID INDUCED BY A ROD PUMPING UNIT

BACKGROUND

The field of the invention relates generally to controlling rod pumping units, and more specifically, to methods and a system for controlling a rod pumping unit to enhance the flow of a fluid induced by the rod pumping unit.

Most known rod pumping units (also known as surface pumping units) are used in wells to induce fluid flow, for example oil and water. The primary function of the linear pumping unit is to convert rotating motion from a prime mover (e.g., an engine or an electric motor) into reciprocating motion above the wellhead. This motion is in turn used to drive a reciprocating down-hole pump via connection through a sucker rod string. The sucker rod string, which can extend miles in length, transmits the reciprocating motion from the wellhead at the surface to subterranean valves in a fluid bearing zone of the well. The reciprocating motion of the valves induces the fluid to flow up the length of the sucker rod string to the wellhead.

The rod pumping units are exposed to a wide range of conditions. These vary by well application, the type and proportions of the pumping unit's linkage mechanism, and the conditions of the well. Furthermore, well conditions, such as downhole pressure, may change over time. These conditions may cause variability in the flow of the fluid. In addition, these conditions affect the sucker rod string. The sucker rod string transmits dynamic loads from the down-hole pump and the rod pumping unit. The sucker rod string behaves similarly to a spring over long distances. The sucker rod string elongates and retracts based on exposure to variable tensile stress. The response of the sucker rod string is damped somewhat due to its submergence in a viscous fluid (water and oil), but the motion profile of the rod pumping unit combined with the step function loading of the pump generally leaves little time for the oscillations to decay before the next perturbation is encountered.

The rod pumping unit imparts continually varying motion on the sucker rod string. The sucker rod string responds to the varying motion by sending variable stress waves down its length to alter its own motion. The sucker rod string stretches and retracts as it builds the force necessary to move the down-hole pump and fluid. The rod pumping unit, breaking away from the effects of friction and fluid inertia, tends to rebound under the elastic force from the sucker rod string initiating an additional oscillatory response within the sucker rod string. Traveling stress waves from multiple sources interfere with each other along the sucker rod string (some constructively, others destructively) as they traverse its length and reflect load variations back to the rod pumping unit, where they can be measured.

BRIEF DESCRIPTION

In one aspect, a system for enhancing a flow of a fluid induced by a rod pumping unit is provided. The system includes a pumping control unit including a processor and a memory. The pumping control unit is configured to control stroke movement of the rod pumping unit, thereby controlling the flow of the fluid induced by the rod pumping unit. The pumping control unit is also configured to store a first set of stroke timing data based on a first pressure level and a second set of stroke timing data based on a second pressure level. The first set of stroke timing data and the second set of stroke timing data are based on a plurality of constraints of the rod pumping unit. The pumping control unit is further configured to store a set of pressure weights based on the first set of stroke timing data, the second set of stroke timing data, and the plurality of constraints and receive a current pressure level. The current pressure level is between the first pressure level and the second pressure level. Moreover, the pumping control unit is also configured to determine a current set of stroke timing data based on the current pressure level, the first set of stroke timing, the second set of stroke timing, and the set of pressure weights and initiate at least one stroke of the rod pumping unit. The at least one stroke is based on the current set of stroke timing data.

In a further aspect, a computer-based method for enhancing a flow of a fluid induced by a rod pumping unit is provided. The method is implemented using a pumping control unit in communication with a memory. The method includes storing a first set of stroke timing data based on a first pressure level and a second set of stroke timing data based on a second pressure level. The first set of stroke timing data and the second set of stroke timing data are based on a plurality of constraints of the rod pumping unit. The method also includes storing a set of pressure weights based on the first set of stroke timing data, the second set of stroke timing data, and the plurality of constraints and receiving a current pressure level. The current pressure level is between the first pressure level and the second pressure level. The method further includes determining a current set of stroke timing data based on the current pressure level, the first set of stroke timing, the second set of stroke timing, and the set of pressure weights and initiating at least one stroke of the rod pumping unit. The at least one stroke is based on the current set of stroke timing data.

In another aspect, a rod pumping unit for inducing a flow of a fluid is provided. The rod pumping unit includes a pumping control unit that includes a processor and a memory. The pumping control unit is configured to control stroke movement of the rod pumping unit, thereby controlling the flow of the fluid induced by the rod pumping unit. The pumping control unit is configured to store a first set of stroke timing data based on a first pressure level and a second set of stroke timing data based on a second pressure level. The first set of stroke timing data and the second set of stroke timing data are based on a plurality of constraints of the rod pumping unit. The pumping control unit is also configured to store a set of pressure weights based on the first set of stroke timing data, the second set of stroke timing data, and the plurality of constraints, and to receive a current pressure level. The current pressure level is between the first pressure level and the second pressure level. The pumping control unit is further configured to determine a current set of stroke timing data based on the current pressure level, the first set of stroke timing, the second set of stroke timing, and the set of pressure weights and initiate at least one stroke of the rod pumping unit. The at least one stroke is based on the current set of stroke timing data.

DRAWINGS

These and other features, aspects, and advantages of the present disclosure will become better understood when the following detailed description is read with reference to the accompanying drawings in which like characters represent like parts throughout the drawings, wherein.

Figure 1B:
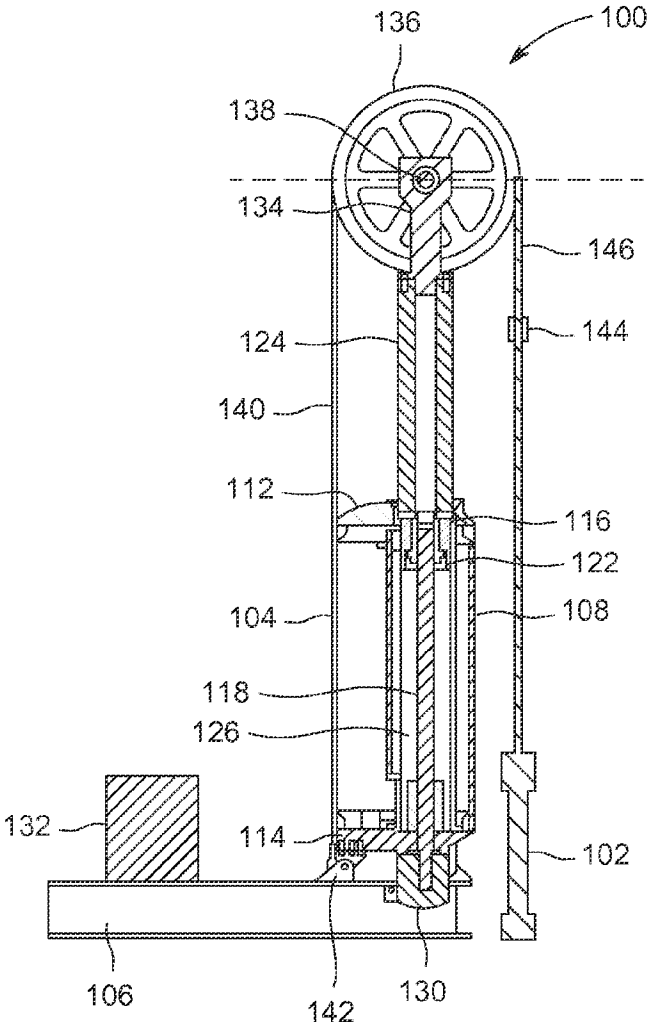
FIG. 1B is a cross-sectional view of the rod pumping unit shown in FIG. 1A in a fully extended position.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that may permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and interchanged; such ranges are identified and include all the sub-ranges contained therein unless context or language indicates otherwise.

As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

The rod pumping control system as described herein provide a cost-effective method for controlling a rod pumping unit to enhance the flow of a fluid induced by the rod pumping unit based on current well conditions. Furthermore, the motion of the rod pumping unit is controlled to ensure that the motion of the sucker rod string will not damage the sucker rod string, the rod pumping unit, or the well itself Also, the system and methods described herein are not limited to any single predefined set of well conditions. For example, the system and methods described herein may be used with varying well conditions and adapt over time as well conditions change. As such, the amount of fluid induced by the rod pumping unit is constantly updated to be enhanced based on current well conditions and the capabilities of the rod pumping unit. As such, the production and efficiency of rod pumping units is increased.

Figure 1A:
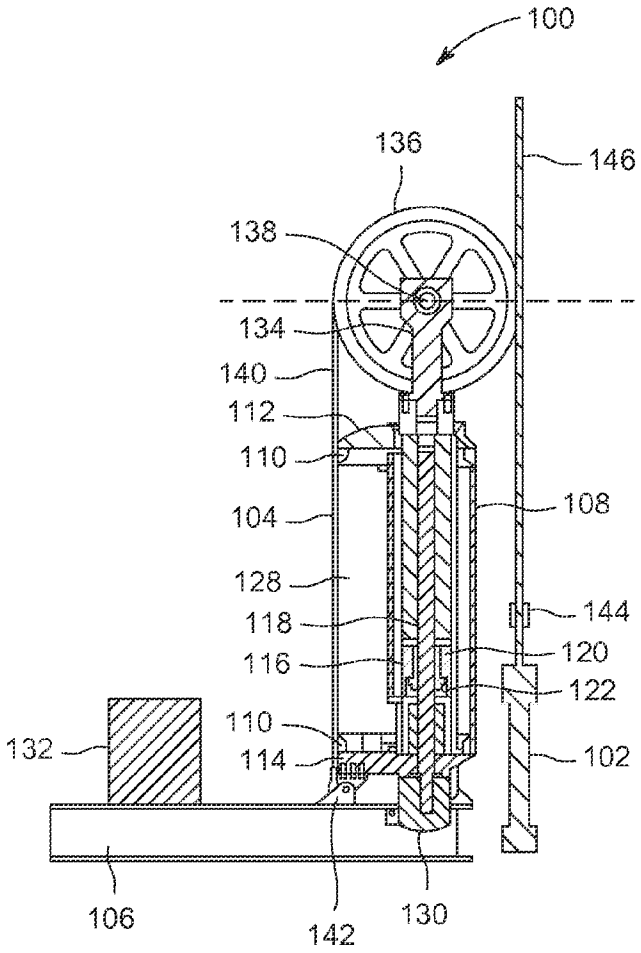
FIG. 1A is a cross-sectional view of an exemplary rod pumping unit in a fully retracted position.

FIGS. 1A and 1B are cross-sectional views of an exemplary rod pumping unit 100 in fully retracted (1A) and fully extended (1B) positions. In the exemplary embodiment, rod pumping unit 100 (also known as a linear pumping unit) is a vertically oriented rod pumping unit having a linear motion vertical vector situated adjacent to a wellhead 102. Rod pumping unit 100 is configured to transfer vertical linear motion into a subterranean well (not shown) through a sucker rod string (not shown) for inducing the flow of a fluid. Rod pumping unit 100 includes a pressure vessel 104 coupled to a mounting base structure 106. In some embodiments, mounting base structure 106 is anchored to a stable foundation situated adjacent to the fluid-producing subterranean well. Pressure vessel 104 may be composed of a cylindrical or other appropriately shaped shell body 108 constructed of formed plate and cast or machined end flanges 110. Attached to the end flanges 110 are upper and lower pressure heads 112 and 114, respectively.

Penetrating upper and lower pressure vessel heads 112 and 114, respectively, is a linear actuator assembly 116. This linear actuator assembly 116 is includes a vertically oriented threaded screw 118 (also known as a roller screw), a planetary roller nut 120 (also known as a roller screw nut assembly), a forcer ram 122 in a forcer ram tube 124, and a guide tube 126.

Roller screw 118 is mounted to an interior surface 128 of lower pressure vessel head 114 and extends up to upper pressure vessel head 112. The shaft extension of roller screw 118 continues below lower pressure vessel head 114 to connect with a compression coupling (not shown) of a motor 130. Motor 130 is coupled to a variable speed drive (VSD) (not shown) configured such that the motor's 130 rotating speed may be adjusted continuously. The VSD also reverses the motor's 130 direction of rotation so that its range of torque and speed may be effectively doubled. Roller screw 118 is operated in the clockwise direction for the upstroke and the counterclockwise direction for the downstroke. Motor 130 is in communication with a pumping unit controller 132. In the exemplary embodiment, pumping unit controller 132 transmits commands to motor 130 and the VSD to control the speed, direction, and torque of roller screw 118.

Within pressure vessel 104, the threaded portion of roller screw 118 is interfaced with planetary roller screw nut assembly 120. Nut assembly 120 is fixedly attached to the lower segment of forcer ram 122 such that as roller screw 118 rotates in the clockwise direction, forcer ram 122 moves upward. Upon counterclockwise rotation of roller screw 118, forcer ram 122 moves downward. This is shown generally in FIGS. lA and 1B. Guide tube 126 is situated coaxially surrounding forcer tube 124 and statically mounted to lower pressure head 114. Guide tube 126 extends upward through shell body 108 to slide into upper pressure vessel head 112.

An upper ram 134 and a wireline drum assembly 136 and fixedly coupled and sealed to the upper end of forcer ram 122. Wireline drum assembly 136 includes an axle 138 that passes laterally through the top section of the upper ram 134. A wireline 140 passes over wireline drum assembly 136 resting in grooves machined into the outside diameter of wireline drum assembly 136. Wireline 140 is coupled to anchors 142 on the mounting base structure 106 at the side of pressure vessel 104 opposite of wellhead 102. At the wellhead side of pressure vessel 104, wireline 140 is coupled to a carrier bar 144 which is in turn coupled to a polished rod 146 extending from wellhead 102.

Rod pumping unit 100 transmits linear force and motion through planetary roller screw nut assembly 120. Motor 130 is coupled to the rotating element of planetary roller screw nut assembly 120. By rotation in either the clockwise or counterclockwise direction, motor 130 may affect translatory movement of planetary roller nut 120 (and by connection, of forcer ram 122) along the length of roller screw 118.

Figure 2:
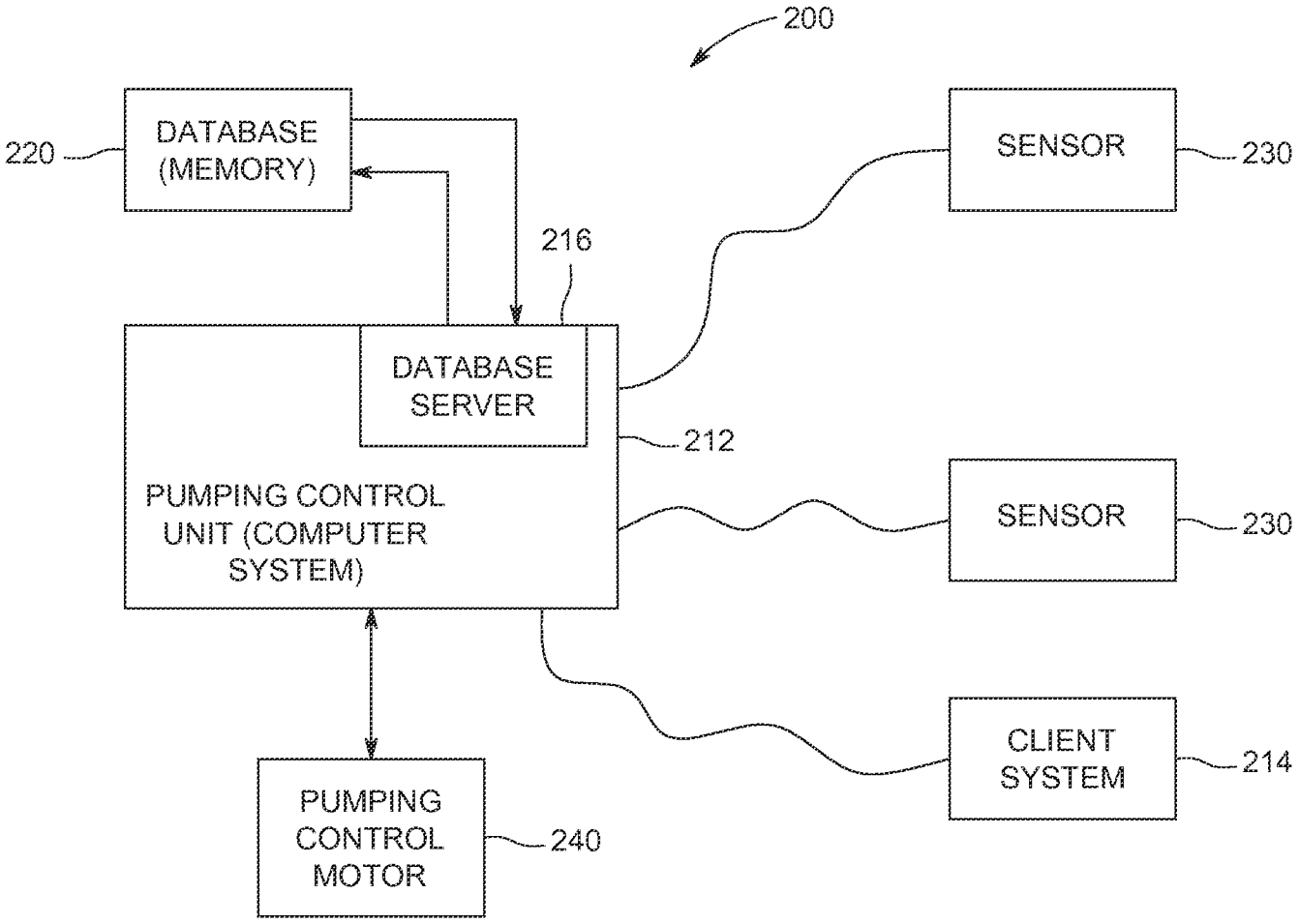
FIG. 2 is a schematic view of a system for controlling the rod pumping unit shown in FIGS. 1A and 1B.

FIG. 2 is a schematic view of a system 200 for controlling rod pumping unit 100 (shown in FIGS. 1A and 1B). In the exemplary embodiment, system 200 is used for compiling and responding to data from a plurality of sensors 230 and controlling the stroke of rod pumping unit 100. A stroke of rod pumping unit 100 represents the time that it takes rod pumping unit 100 to extend from fully retracted to fully extended and back to fully retracted, as shown in FIGS. lA and 1B. Sensors 230 are in communication with a pumping control unit 212. Sensors 230 connect to pumping control unit 212 through many interfaces including without limitation a network, such as a local area network (LAN) or a wide area network (WAN), dial-in-connections, cable modems, Internet connection, wireless, and special high-speed Integrated Services Digital Network (ISDN) lines. Sensors 230 receive data about conditions of rod pumping unit 100 and report those conditions to pumping control unit 212. Pumping control unit 212 may include, but is not limited to, pumping unit controller 132 (shown in FIG. 1).

Pumping control unit 212 is in communication with pumping control motor 240. In the exemplary embodiment, pumping control motor 240 includes motor 130 (shown in FIG. 1A) and a VSD (not shown). Pumping control motor 240 transmits data to pumping control unit 212 and receives commands from pumping control unit 212. Pumping control motor 240 connects to pumping control unit 212 through many interfaces including without limitation a network, such as a local area network (LAN) or a wide area network (WAN), dial-in-connections, cable modems, Internet connection, wireless, and special high-speed Integrated Services Digital Network (ISDN) lines.

A database server 216 is coupled to database 220, which contains information on a variety of matters, as described below in greater detail. In one embodiment, centralized database 220 is stored on pumping control unit 212. In an alternative embodiment, database 220 is stored remotely from pumping control unit 212 and may be non-centralized. In some embodiments, database 220 includes a single database having separated sections or partitions or in other embodiments, database 220 includes multiple databases, each being separate from each other. Database 220 stores condition data received from multiple sensors 230. In addition, database 220 stores constraints, component data, component specifications, equations, and historical data generated as part of collecting condition data from multiple sensors 230.

Pumping control unit 212 is in communication with a client system 214. Pumping control unit 212 connects to client system 214 through many interfaces including without limitation a network, such as a local area network (LAN) or a wide area network (WAN), dial-in-connections, cable modems, Internet connection, wireless, and special high-speed Integrated Services Digital Network (ISDN) lines. Pumping control unit 212 transmits data about the operation of rod pumping unit 100 to client system 214. This data could include data from sensors, current strokes per minute and other operational data that client system 214 could monitor. Furthermore, pumping control unit 212 receives additional instructions from client system 214 or updated stroke timing data. Additionally, client system 214 accesses database 220 through pumping control unit 212. Client system 214 presents the data from pumping control unit to a user. In other embodiments, pumping control unit 212 includes a display unit (not shown) to display data directly to a user (not shown).

Figure 3:
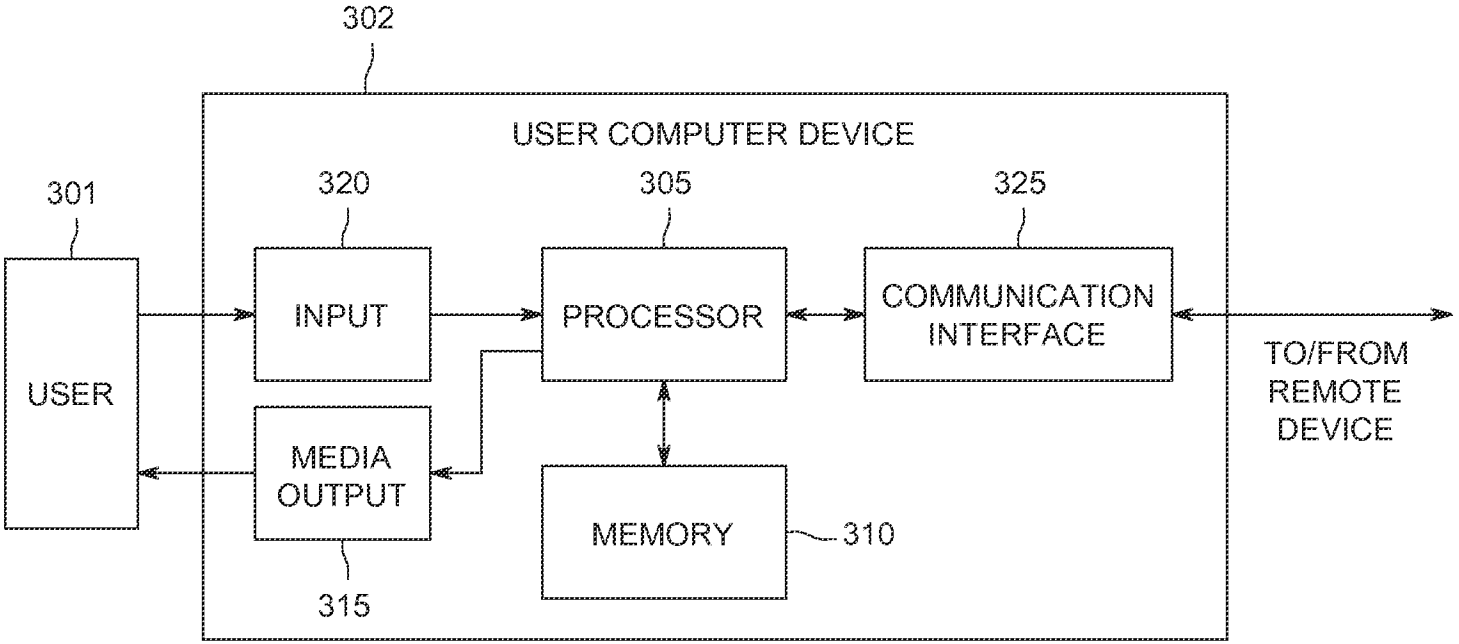
FIG. 3 is a schematic view of an exemplary configuration of a client system that may be used with the system shown in FIG. 2.

FIG. 3 is a schematic view of an example configuration of a client system 214 that may be used with system 200 (both shown in FIG. 2). User computer device 302 is operated by a user 301. User computer device 302 may include, but is not limited to, client systems 214 (shown in FIG. 2). User computer device 302 includes a processor 305 for executing instructions. In some embodiments, executable instructions are stored in a memory area 310. Processor 305 may include one or more processing units (e.g., in a multi-core configuration). Memory area 310 is any device allowing information such as executable instructions and/or transaction data to be stored and retrieved. Memory area 310 may include one or more computer readable media.

User computer device 302 also includes at least one media output component 315 for presenting information to user 301. Media output component 315 is any component capable of conveying information to user 301. In some embodiments, media output component 315 includes an output adapter (not shown) such as a video adapter and/or an audio adapter. An output adapter is operatively coupled to processor 305 and operatively coupleable to an output device such as a display device (e.g., a cathode ray tube (CRT), liquid crystal display (LCD), light emitting diode (LED) display, or "electronic ink" display) or an audio output device (e.g., a speaker or headphones). In some embodiments, media output component 315 is configured to present a graphical user interface (e.g., a web browser and/or a client application) to user 301. A graphical user interface may include, for example, an online store interface for viewing and/or purchasing items, and/or a wallet application for managing payment information. In some embodiments, user computer device 302 includes an input device 320 for receiving input from user 301. User 301 may use input device 320 to, without limitation, select and/or enter one or more items to purchase and/or a purchase request, or to access credential information, and/or payment information. Input device 320 may include, for example, a keyboard, a pointing device, a mouse, a stylus, a touch sensitive panel (e.g., a touch pad or a touch screen), a gyroscope, an accelerometer, a position detector, a biometric input device, and/or an audio input device. A single component such as a touch screen may function as both an output device of media output component 315 and input device 320.

User computer device 302 may also include a communication interface 325, communicatively coupled to a remote device such as pumping control unit 212 (shown in FIG. 2). Communication interface 325 may include, for example, a wired or wireless network adapter and/or a wireless data transceiver for use with a mobile telecommunications network.

Stored in memory area 310 are, for example, computer readable instructions for providing a user interface to user 301 via media output component 315 and, optionally, receiving and processing input from input device 320. A user interface may include, among other possibilities, a web browser and/or a client application. Web browsers enable users, such as user 301, to display and interact with media and other information typically embedded on a web page or a website from pumping control unit 212. A client application allows user 301 to interact with, for example, pumping control unit 212. For example, instructions may be stored by a cloud service, and the output of the execution of the instructions sent to the media output component 315.

Processor 305 executes computer-executable instructions for implementing aspects of the disclosure. In some embodiments, processor 305 is transformed into a special purpose microprocessor by executing computer-executable instructions or by otherwise being programmed. For example, processor 305 is programmed with instructions discussed further below.

Figure 4:
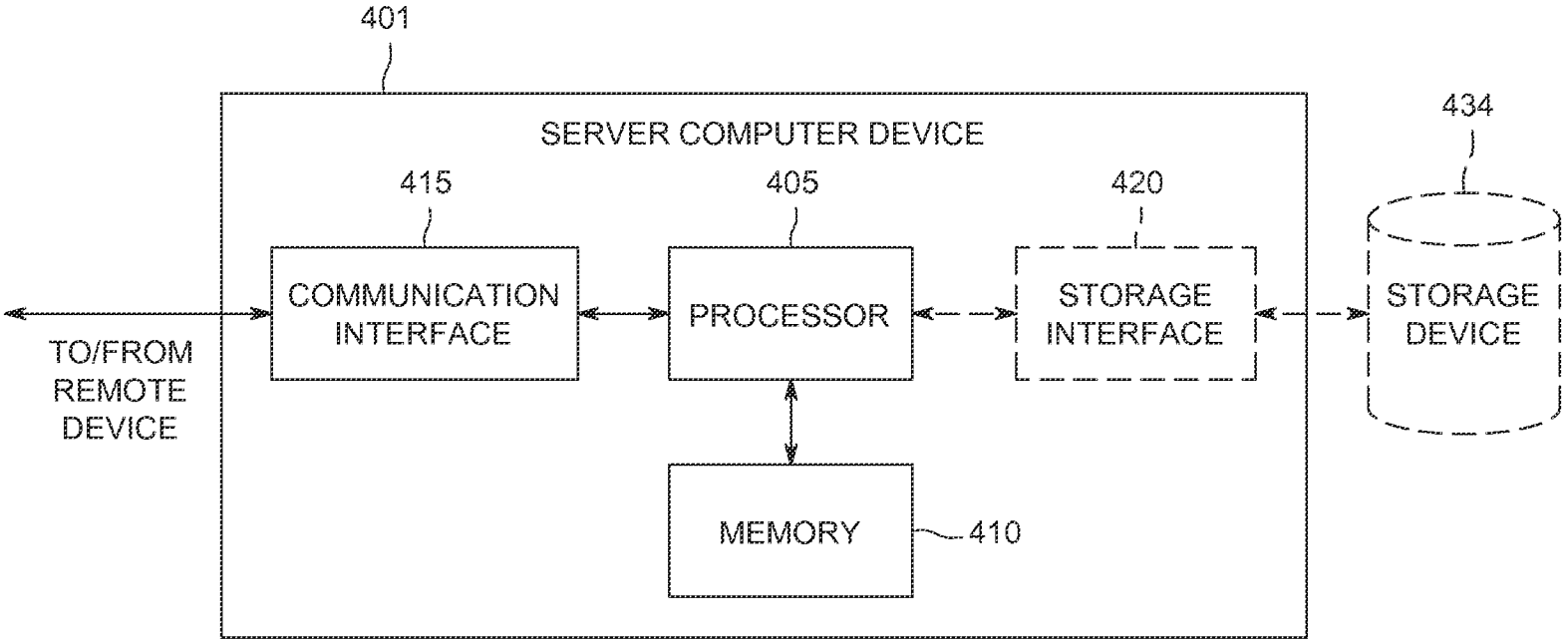
FIG. 4 is a schematic view of an exemplary configuration of a pumping control unit that may be used with the system shown in FIG. 2.

FIG. 4 is a schematic view of an exemplary configuration of pumping control unit 212 that may be used with system 200 (both shown in FIG. 2). More specifically, server computer device 401 may include, but is not limited to, pumping control unit 212 and database server 216 (both shown in FIG. 2). Server computer device 401 also includes a processor 405 for executing instructions. Instructions may be stored in a memory area 410. Processor 405 may include one or more processing units (e.g., in a multi-core configuration).

Processor 405 is operatively coupled to a communication interface 415 such that server computer device 401 is capable of communicating with a remote device, such as another server computer device 401, sensors 230 (shown in FIG. 2), pumping control motor 240 (shown in FIG. 2), or client systems 214 (shown in FIG. 2). For example, communication interface 415 may receive requests from client systems 214, as illustrated in FIG. 2.

Processor 405 is also operatively coupled to a storage device 434. Storage device 434 is any computer-operated hardware suitable for storing and/or retrieving data, such as, but not limited to, data associated with database 220 (shown in FIG. 2). In some embodiments, storage device 434 is integrated in server computer device 401. For example, server computer device 401 may include one or more hard disk drives as storage device 434. In other embodiments, storage device 434 is external to server computer device 401 and may be accessed by a plurality of server computer devices 401. For example, storage device 434 may include a storage area network (SAN), a network attached storage (NAS) system, and/or multiple storage units such as hard disks and/or solid state disks in a redundant array of inexpensive disks (RAID) configuration.

In some embodiments, processor 405 is operatively coupled to storage device 434 via a storage interface 420. Storage interface 420 is any component capable of providing processor 405 with access to storage device 434. Storage interface 420 may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor 405 with access to storage device 434.

Processor 405 executes computer-executable instructions for implementing aspects of the disclosure. In some embodiments, the processor 305 is transformed into a special purpose microprocessor by executing computer-executable instructions or by otherwise being programmed For example, the processor 405 is programmed with instructions as described further below.

Figure 5:
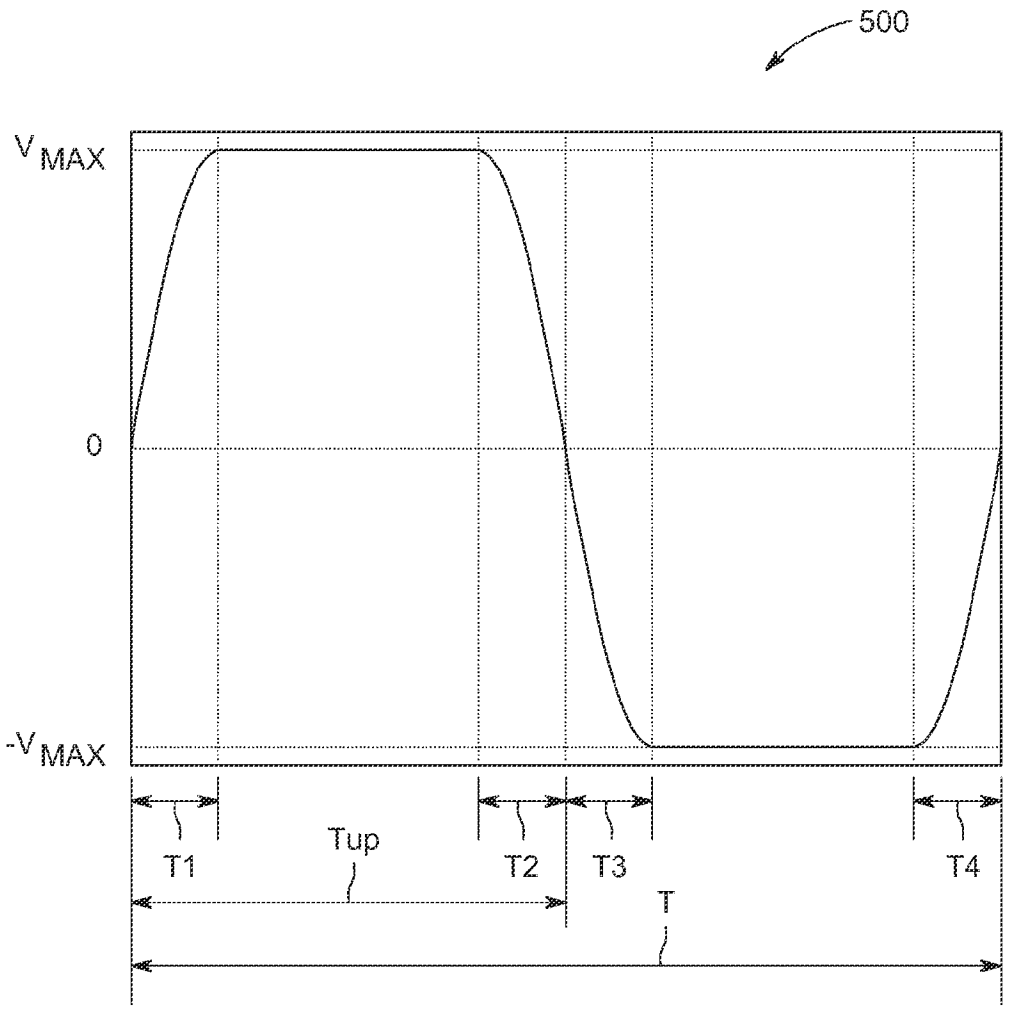
FIG. 5 is a graphical view of an exemplary velocity profile of a stroke of the rod pumping unit shown in FIGS. 1A and 1B.

FIG. 5 is a graphical view of an exemplary velocity profile 500 of a stroke of rod pumping unit 100 (shown in FIGS. lA and 1B). Velocity profile 500 illustrates the velocity of the upper ram 134 (shown in FIG. 1B). The x-axis of velocity profile 500 is time T and the y-axis is the velocity of upper ram 134 in relation to mounting base structure 106 (both shown in FIG. 1A). Time T represents the time that it takes rod pumping unit 100 to complete one stroke from fully retracted to fully extended and back to fully retracted. Therefore if T is equal to 60 seconds, then rod pumping unit 100 completes 1 stroke per minute (SPM). If T is equal to 10 seconds, then SPM is 6.

On the left side of velocity profile at time T=0 rod pumping unit 100 is fully retracted as is shown in FIG. 1A.

Time Tup represents the amount of time that it takes for rod pumping unit to go from fully retracted to fully extended. Tup is also known as the upstroke time, while (T-Tup) is the downstroke time. Vmax is the maximum velocity at which rod pumping unit 100 may extend or retract. In the exemplary embodiment, Vmax is based on the attributes of rod pumping unit 100. In the exemplary embodiment, the absolute value of Vmax on the upstroke is the same as absolute value of Vmax on the downstroke. However, in other embodiments, the absolute values of the upstroke and downstroke velocities are different.

Time T1 represents the amount of time it takes for rod pumping unit 100 to accelerate from a standstill condition, i.e., velocity equal to 0, to Vmax while extending. Time T2 represents the amount of time it takes rod pumping unit 100 to decelerate from Vmax to 0 while extending, when rod pumping unit 100 reaches the apex of its extension. Time T3 represents the amount of time it takes for rod pumping unit 100 to accelerate from still to −Vmax while retracting. Time T4 represents the amount of time it takes rod pumping unit 100 to decelerate from −Vmax to 0 while retracting, when rod pumping unit 100 becomes fully retracted. In some embodiments, T4 is the same amount of time as T1.

Pumping control unit 212 sets T, Tup, T1, T2, T3, and T4 and instructs pumping control motor 240 (shown in FIG. 2) to rotate roller screw 118 (shown in FIG. 1) to implement the required timing. These variables are also known as the stroke timing as they control each stage of the stroke. In the exemplary embodiment, Tup, T1, T2, T3, and T4 are stored as percentages of T. For example, if T1 is 10%, then the upstroke acceleration stage will take up 10% of the total stroke time.

Figure 6:
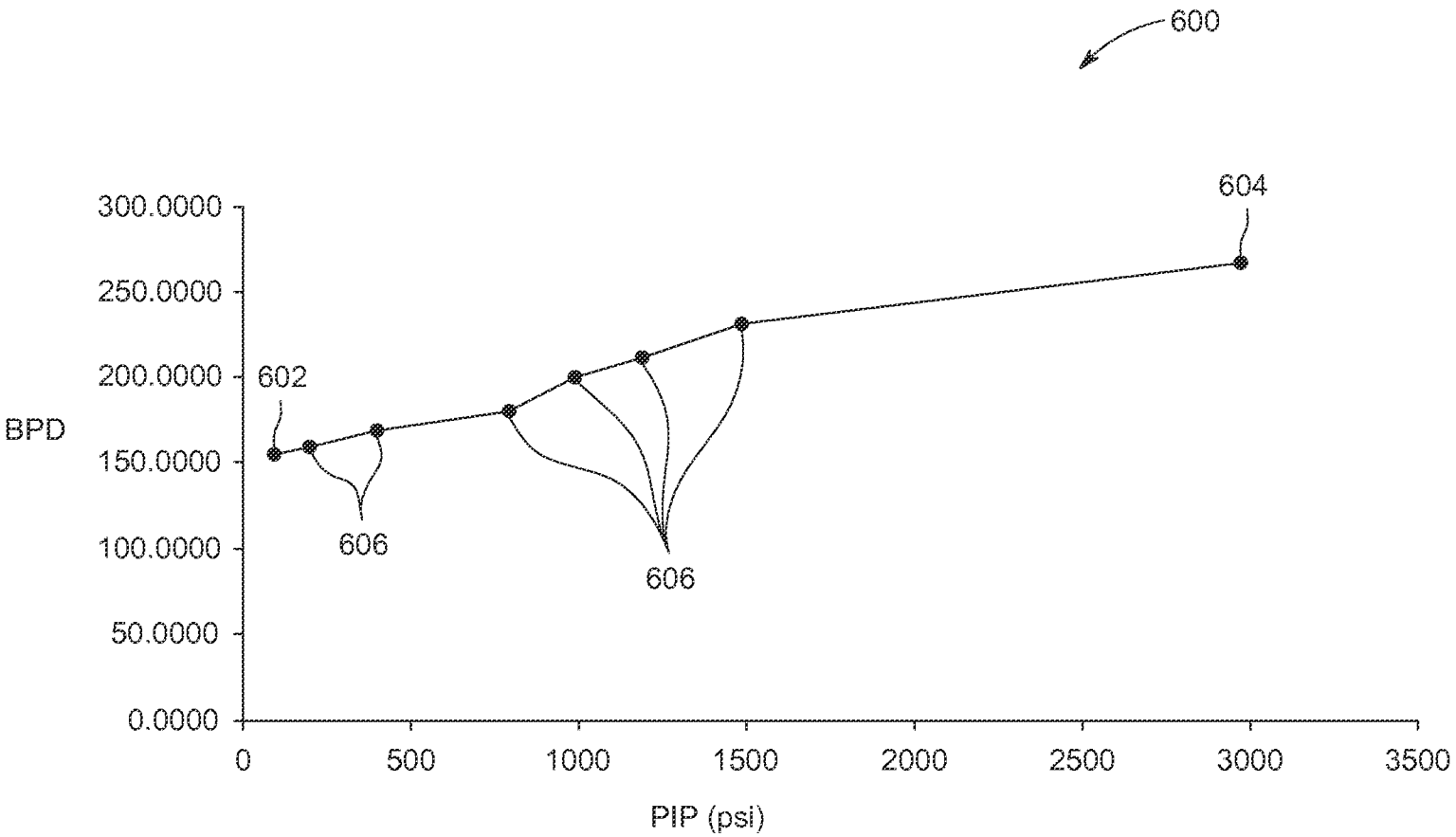
FIG. 6 is a graphical view an exemplary chart of primary and secondary stroke timings for use with the rod pumping unit shown in FIGS. 1A and 1B.

FIG. 6 is a graphical view of an exemplary chart 600 of primary and secondary stroke timings for use with rod pumping unit 100 (shown in FIGS. 1A and 1B). Chart 600 illustrates the amount of induced fluid flow at different stroke timings, which are calculated for different pump intake pressures (PIP) (also known as downhole pressure). The x-axis of chart 600 is PIP and the y-axis is barrels per day (BPD), the amount of flow of fluid induced using the associated stroke timing Each point on chart 600 represents a different stroke timing for rod pumping unit 100. Stroke timings 602 and 604 represent primary profiles based on predetermined conditions. In the exemplary embodiment, stroke timing 602 is based on a PIP for 100 psi and stroke timing 604 is based on a PIP of 3000 psi. Stroke timings 602 and 604 are calculated for the greatest BPD in view of a plurality of constraints. Chart 600 also includes secondary stroke timings 606, which are interpolated based on the low 602 and high 604 primary stroke timings.

Primary stroke timings 602 and 604 are calculated at points at the two ends of the spectrum for well conditions, where actual well conditions are expected to be between those two points. Primary stroke timings 602 and 604 are calculated for the greatest flow of fluid induced for those conditions and within the constraints. In the exemplary embodiment, there are four sets of constraints, buckling constraints, fatigue constraints, torque and screw force balancing constraints, and physical constraints.

The first set of constraints is designed to prevent buckling of the sucker rod string (not shown). The cross-section of the sucker rod string is not constant and varies along its length. To account for these varying thicknesses, the minimum effective load is calculated at multiple points (also known as taper points). The minimum effective load is further modified by a safety factor. These constraints are updated based on the dimensions of the sucker rod string and will be updated when a different sucker rod string with different dimensions is used.

The second set of constraints is designed to prevent fatigue in the sucker rod string. The sucker rod string is constantly under tension and less tension. These varying tensions are configured to prevent ever putting the sucker rod string under compression force. These constant changes in tension are a cyclical stress on the sucker rod string. The effect that this cyclical stress has on the sucker rod string is known as fatigue. The fatigue constraints are based on the maximum and minimum stress that is placed on the sucker rod string during a cycle in view of the tensile strength of the sucker rod. These constraints are further modified by a service factor. In the exemplary embodiment, the service factor is in addition to any safety factor being used and reflects the condition of the well.

The third set of constraints is based on the torque and screw force balancing. These constraints are configured to balance the torque for motor 130 and the force that is placed on the roller screw 118 (both shown in FIG. 1). These constraints are based on the tolerance that motor 130 and roller screw 118 experiences and are shown as the equations:

$$T_{tol} = \frac{||T_{max}| - |T_{min}||}{\max(|T_{max}|, |T_{min}|)}, \quad \text{Eq. (1)}$$

where Tmax and Tmin are the maximum and minimum torque that motor 130 and roller screw 118 experiences and $$F_{screw,tol} = \frac{||F_{max}| - |F_{min}||}{\max(|F_{max}|, |F_{min}|)}, \quad \text{Eq. (2)}$$

where Fmax and Fmin are the maximum and minimum force that motor 130 and roller screw 118 experiences.

The fourth set of constraints is based on the physical attributes of rod pumping unit 100. These constraints may vary based on model or between different rod pumping units. These constraints include, but are not limited to, a maximum polished rod load, a minimum and maximum screw force, a maximum power of the motor, root mean square power for the motor, maximum torque for the motor, root mean square torque for the motor, allowable pressure rating of pressure vessel 104 (shown in FIG. 1), and maximum rotations per minute of motor 130. These constraints may have to be updated as parts are swapped out in rod pumping unit 100.

Figure 7:
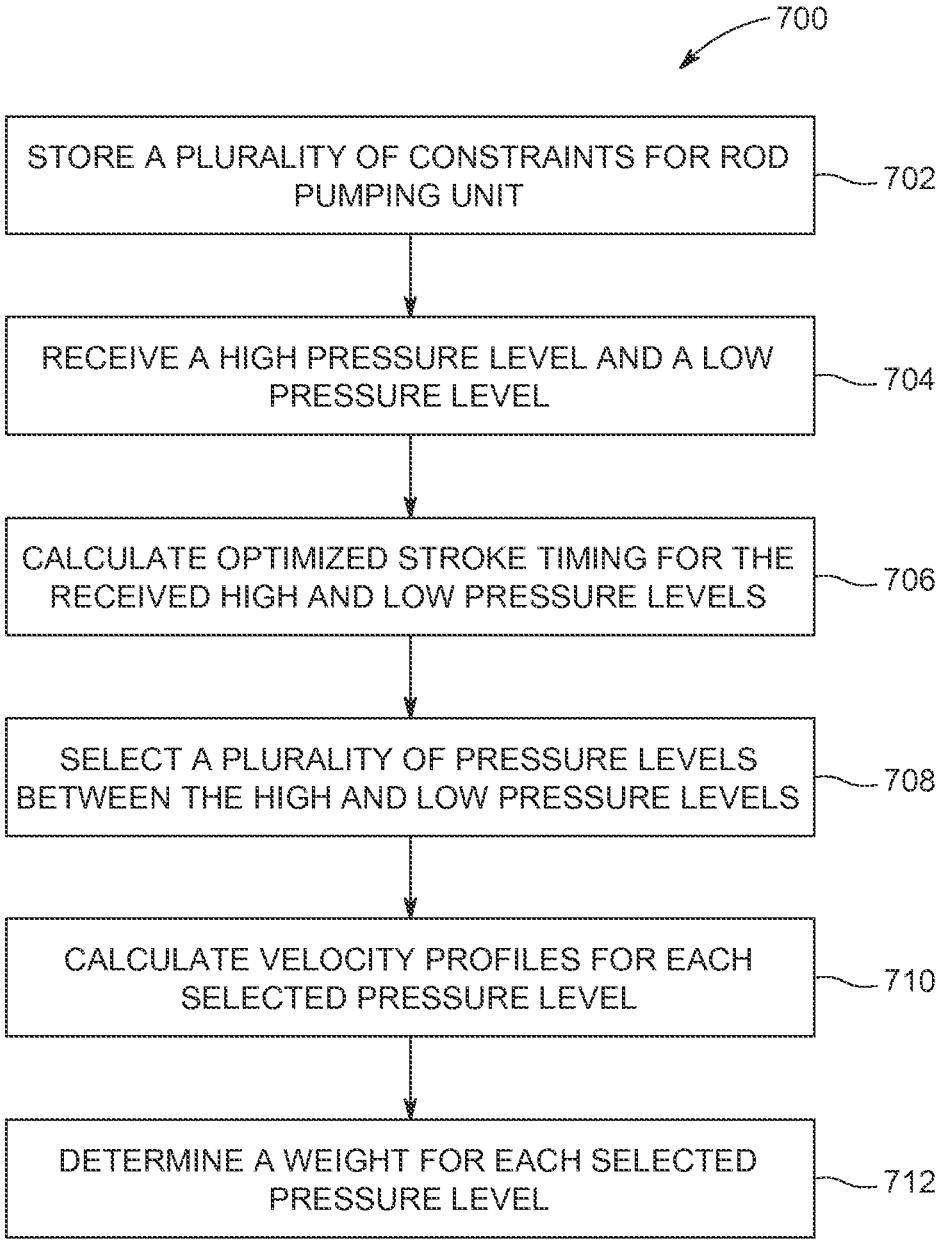
FIG. 7 is a flow chart of a process of generating the primary and secondary stroke timings shown in FIG. 6.

FIG. 7 is a flow chart of a process 700 of generating the primary (602 and 604) and secondary stroke timings 606 (all shown in FIG. 6). In the exemplary embodiment, process 700 is performed by client system 214 (shown in FIG. 2), which is located separately from rod pumping device 100 (shown in FIG. 1). In some embodiments, client system 214 is a mobile device that a user directly connects to pumping control system 212 (shown in FIG. 2). Client system 214 transmits the primary and secondary stroke timings to pumping control unit 212. In other embodiments, process 700 is performed by pumping control unit 212.

Client system 214 stores 702 a plurality of constraints for rod pumping unit 100. Client system 214 receives 704 a high pressure level and a low pressure level from a user. The high level and low levels are at two extreme levels for pressure, such that conditions at the well are expected to be between those two levels. In the exemplary embodiment, the high level and the low level are set at 3000 psi and 100 psi, respectively. Client system 214 calculates 706 the optimal stroke timing at each of the two levels to create the high and low optimize stroke timings 602 and 604. The calculations are based on the constraints and are calculated for the highest fluid flow possible. In the exemplary embodiment, fluid flow is based on barrels per day (BPD). Examples of primary stroke timings at high 604 and low levels 602 are shown in Table 1.

TABLE 1

| Variable | Primary stroke timings | |
|---|---|---|
| PIP (psi) | 100 | 3000 |
| SPM | 6.3333 | 13.4 |
| T1 (%) | 15 | 10 |
| T2 (%) | 10 | 12 |
| T3 (%) | 6 | 8 |
| T3 (%) | 9 | 7 |
| BPD | 178.24 | 355.89 |

Once the primary stroke timings are calculated, client system 214 selects 708 a plurality of pressure levels between the high level and the low level. In the exemplary embodiment, the plurality of pressure levels is selected by the user. In other embodiments, the plurality of pressure levels is selected by client system 214. Client system 214 calculates 710 stroke timings for each of the selected plurality of pressure level. Client system 214 determines 712 a weight for each selected pressure level. For each pressure level, client system 214 calculates a minimum weight m that satisfies all of the constraints while giving the greatest value of BPD for that pressure level. The weight m is based on the following equation, where X may be any variable of the current stroke timing, such as Ti or T.

$$X(\text{PIP})=m*X(100\text{ psi})+(1-m)*X(3000\text{ psi}) \quad \text{Eq. (3)}$$

where X is the desired variable, such as T1 or T, PIP is the desired downhole pressure, X(100 psi) is the desired variable calculated at 100 psi from primary stroke timing 602, X(3000 psi) is the desired variable calculated at 3000 psi from primary stroke timing 604, and m is the weight for calculating the greatest value of BPD at PIP.

For example, the results of applying the above equation to multiple pressure levels may be seen below in Table 2. 100 and 3000 are the primary levels 602 and 604, while 200, 400, 800, 1000, 1200, and 1500 represent the secondary levels 606.

TABLE 2

| PIP | 100 | 200 | 400 | 800 | 1000 | 1200 | 1500 | 3000 |
|---|---|---|---|---|---|---|---|---|
| m | 1 | 0.96 | 0.86 | 0.77 | 0.37 | 0.16 | 0 | 0 |
| SPM | 6.33 | 6.61 | 7.32 | 7.95 | 10.78 | 12.26 | 13.4 | 13.4 |
| T1 (%) | 15 | 14.8 | 14.3 | 13.85 | 11.85 | 10.8 | 10 | 10 |
| T2 (%) | 10 | 10.08 | 10.28 | 10.46 | 11.26 | 11.68 | 12 | 12 |
| T3 (%) | 6 | 6.08 | 6.28 | 6.46 | 7.26 | 7.68 | 8 | 8 |
| T4 (%) | 9 | 8.92 | 8.72 | 8.54 | 7.74 | 7.32 | 7 | 7 |
| BPD | 178.24 | 185.34 | 203.11 | 219.09 | 290.15 | 327.46 | 330 | 355.89 |

The above calculations provide a pair of primary stroke timings 602 and 604 and a plurality of secondary stroke timings 606 for use with rod pumping unit 100. In the exemplary embodiment, only the different values of m (the set of weights) for the different pressure levels and the primary stroke timings for the high and low levels are provided to pumping control unit 212. In other embodiments, the primary and secondary stroke timings are provided to pumping control unit 212. Pumping control unit 212 then uses the stroke timings to control the strokes of rod pumping unit 100.

In additional embodiments, the above calculations are performed for downhole gas fraction, where PIP is kept at a constant value. In these additional embodiments, primary stroke timings are calculated for a high and a low value of downhole gas fraction. Then those primary stroke timings are used to calculate secondary stroke timings for selected downhole gas fraction levels between the high and low downhole gas fraction levels.

Figure 8:
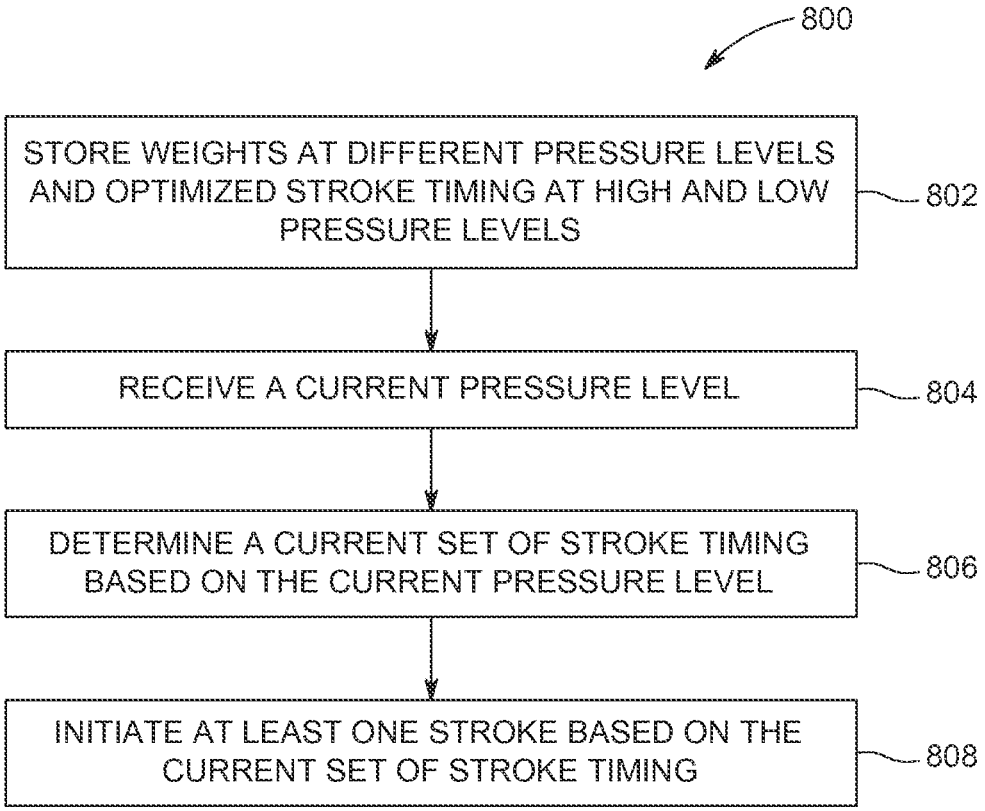
FIG. 8 is a flow chart of a pressure-based pumping process using the rod pumping unit shown in FIGS. 1A and 1B.

FIG. 8 is a flow chart of a pressure-based pumping process 800 using rod pumping unit 100 (shown in FIGS. 1A and 1B). Process 800 is configured to increase the flow of fluid induced by rod pumping unit 100, while ensuring safe operation based on current conditions. Pumping control unit 212 (shown in FIG. 2) stores 802 the values for m (the weights) at the different pressure levels and the primary stroke timings for the high and low pressure levels generated through process 700 (shown in FIG. 7). Pumping control unit 212 receives 804 a current pressure level. In some embodiments, pumping control unit 212 receives 804 the current pressure level from one or more sensors 230 (shown in FIG. 2). In other embodiments, the current pressure level is estimated based on conditions at the well. In still further embodiments, pumping control unit 212 receives 804 the current pressure level from client system 214 (shown in FIG. 2).

Pumping control unit 212 determines 806 a set of current stroke timing based on the current pressure level. Pumping control unit 212 compares the current pressure level with the pressure levels associated with the stored weights. If the current pressure level is the same as one associated with a stored weight, then pumping control unit 212 applies Equation (3) using the matching weight to determine a set of current stroke timing. For example, if the current pressure level is 400 psi, then pumping control unit 212 will determine the current stroke timing to match those values shown in Table 2 for 400 psi. If the current pressure level is between two pressure levels with associated weights, pumping control unit 212 calculates a line for the two pressure levels and the associated weights. Using the calculated line, pumping control unit 212 determines a weight for the current pressure level. Pumping control unit 212 applies Equation (3)1 using the determined weight to calculate a current set of stroke timing. In some embodiments, the line is calculated to fit over several pressure levels. Pumping control unit 212 initiates 808 at least one stroke based on the current set of stroke timing.

Figure 9:
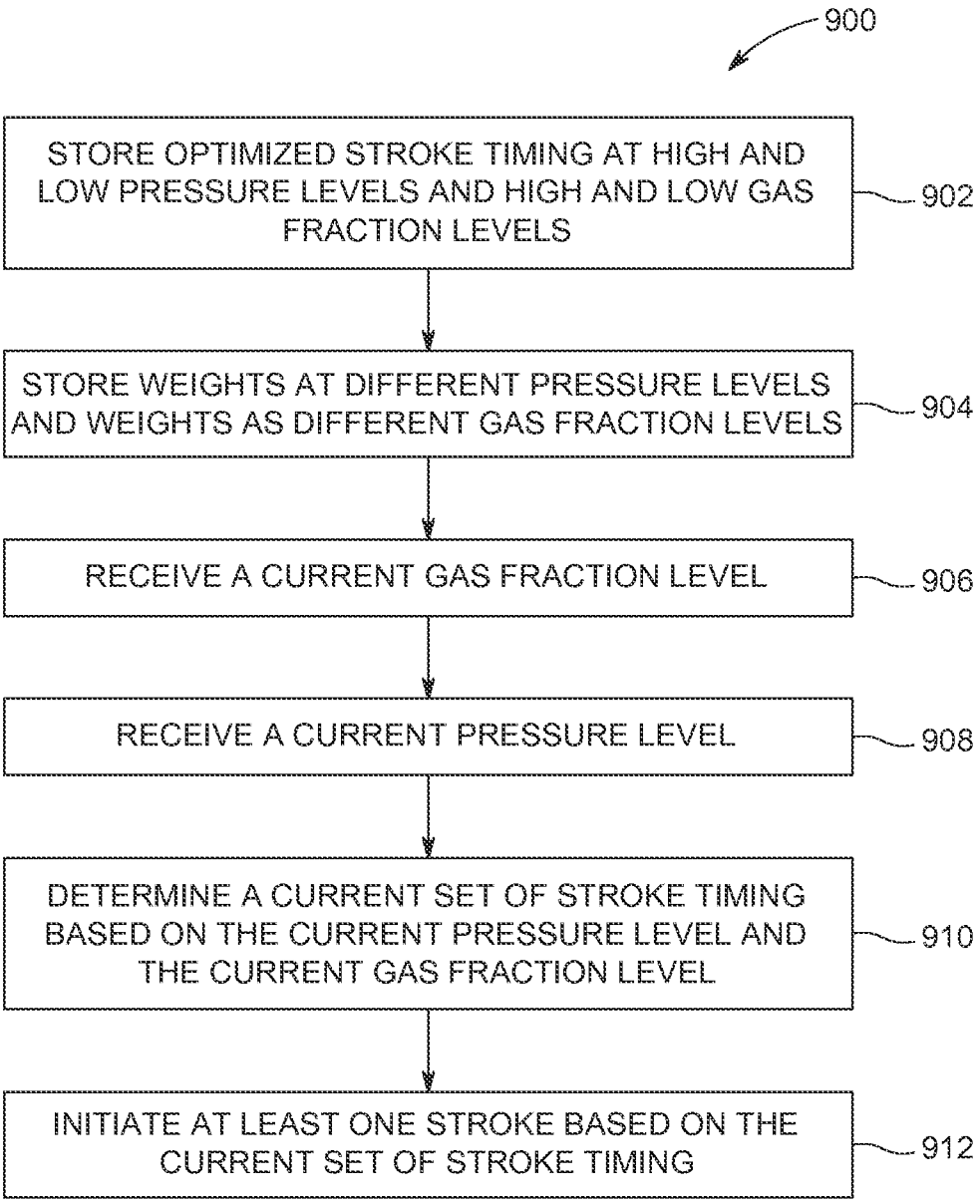
FIG. 9 is a flow chart of a pressure and gas fraction based pumping process using the rod pumping unit shown in FIGS. 1A and 1B.

FIG. 9 is a flow chart of a pressure and gas fraction based pumping process 900 using rod pumping unit 100 (shown in FIGS. 1A and 1B). Process 900 is configured to increase the flow of fluid induced by rod pumping unit 100, while ensuring safe operation based on current conditions. Pumping control unit 212 (shown in FIG. 2) stores 902 four sets of primary stroke timing based on the following four condition sets: low pressure level and low gas fraction level, low pressure level and high gas fraction level, high pressure level and low gas fraction level, and high pressure level and high gas fraction level. Pumping control unit 212 stores 904 two sets of values for m (the weights), one set for the pressure levels and one set for gas fraction levels. The pressure levels for the pressure weights are between the high pressure level and the low pressure level. The gas fraction levels associated with the gas fraction weights are between the high gas fraction level and the low gas fraction level. In the exemplary embodiment, both sets of weights are calculated using process 700 (shown in FIG. 7). While in other embodiments, the weights are calculated on a polynomial basis.

Pumping control unit 212 receives 906 a current gas fraction level. Pumping control unit 212 receives 908 a current pressure level. Pumping control unit 212 determines 910 a current set of stroke timing based on the current pressure level and the current gas fraction level. Pumping control unit 212 uses the four sets of primary stroke timing and the two sets of weights to calculate one or more weights for the current gas fraction level and the current pressure level. Pumping control unit 212 applies the one or more calculated weights to the four sets of primary stroke timing to determine the current stroke timing. Pumping control unit 212 initiates 912 at least one stroke based on the current set of stroke timing The above-described system and methods provide a cost-effective method for controlling a rod pumping unit to enhance the flow of a fluid induced by the rod pumping unit based on current well conditions. Furthermore, the motion of the rod pumping unit is controlled to ensure that the motion of the sucker rod string will not damage the sucker rod string, the rod pumping unit, or the well itself. Also, the system and methods described herein are not limited to any single predefined set of well conditions. For example, the system and methods described herein may be used with varying well conditions and adapt over time as well conditions change. As such, the amount of flow of fluid induced by the rod pumping unit is constantly updated to be enhanced based on current well conditions and the capabilities of the rod pumping unit. As such, the production and efficiency of rod pumping units is increased.

An exemplary technical effect of the methods, systems, and apparatus described herein includes at least one of: (a) determining current stroke timing for current well conditions for a rod pumping unit based on predetermined stroke timing for predetermined conditions, where the current stroke timing and the predetermined stroke timing are calculated to reduce any stresses on the sucker rod string and the rod pumping unit while enhancing fluid flow; and (b) initiating a new stroke based on the adjusted stroke timing for enhanced fluid flow while reducing the stress on the sucker rod string and the rod pumping unit.

Exemplary embodiments of systems and methods for controlling the stroke of a rod pumping unit to control the flow of a fluid are described above in detail. The systems and methods described herein are not limited to the specific embodiments described herein, but rather, components of systems or steps of the methods may be utilized independently and separately from other components or steps described herein. For example, the methods may also be used in combination with other linear pumping units, and are not limited to practice with only linear pumping units as described herein. Additionally, the methods may also be used with other well conditions, and are not limited to practice with only the well conditions as described herein. Rather, the exemplary embodiments may be implemented and utilized in connection with many other pumping control applications.

Although specific features of various embodiments may be shown in some drawings and not in others, this is for convenience only. In accordance with the principles of the systems and methods described herein, any feature of a drawing may be referenced or claimed in combination with any feature of any other drawing.

Some embodiments involve the use of one or more electronic or computing devices. Such devices typically include a processor or controller, such as a general purpose central processing unit (CPU), a graphics processing unit (GPU), a microcontroller, a reduced instruction set computer (RISC) processor, an application specific integrated circuit (ASIC), a programmable logic circuit (PLC), or any other circuit or processor capable of executing the functions described herein. The methods described herein may be encoded as executable instructions embodied in a computer readable medium, including, without limitation, a storage device or a memory device. Such instructions, when executed by a processor, cause the processor to perform at least a portion of the methods described herein. The above examples are exemplary only, and thus are not intended to limit in any way the definition or meaning of the term processor.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system for enhancing a flow of a fluid induced by a rod pumping unit, said system comprising:

a pumping control unit comprising a processor and a memory, said pumping control unit configured to control stroke movement of the rod pumping unit, thereby controlling the flow of the fluid induced by the rod pumping unit, said pumping control unit configured to:

store a first set of stroke timing data based on a first pressure level and a first gas fraction level, a second set of stroke timing data based on a second pressure level and the first gas fraction level, a third set of stroke timing data based on the first pressure level and a second gas fraction level, and a fourth set of stroke timing data based on the second pressure level and the second gas fraction level, the first set of stroke timing data, the second set of stroke timing data, the third set of stroke timing data, and the fourth set of stroke timing data is based on a plurality of constraints of the rod pumping unit;

store a set of pressure weights based on the first set of stroke timing data, the second set of stroke timing data, and the plurality of constraints;

store a set of gas fraction weights based on the first set of stroke timing data, the second set of stroke timing data, the third set of stroke timing data, the fourth set of stroke timing data, and the plurality of constraints;

receive a current pressure level, wherein the current pressure level is between the first pressure level and the second pressure level;

receive a current gas fraction level, wherein the current gas fraction level is between the first gas fraction level and the second gas fraction level;

determine a current set of stroke timing data based on the current pressure level, the first set of stroke timing data, the second set of stroke timing data, the set of pressure weights, the current gas fraction level, and the set of gas fraction weights; and initiate at least one stroke of the rod pumping unit, wherein the at least one stroke is based on the current set of stroke timing data.

2. The system in accordance with claim 1, wherein the set of gas fraction weights is based on one or more additional pressure levels between the first pressure level and the second pressure level, and is further based on one or more additional gas fraction levels between the first gas fraction level and the second gas fraction level.

3. The system in accordance with claim 1, wherein the third set of stroke timing data and the fourth set of stroke timing data based on the plurality of constraints facilitate enhancing an amount of flow of fluid induced by the rod pumping unit.

4. The system in accordance with claim 1, wherein the plurality of constraints comprises one or more buckling criterion, one or more fatigue criterion, and one or more physical attributes of the rod pumping unit.

5. The system in accordance with claim 4, wherein the plurality of constraints further comprises one or more torque criterion balancing a torque applied to the rod pumping unit and one or more screw force criterion balancing a screw force applied to the rod pumping unit.

6. The system in accordance with claim 1, wherein the current stroke timing data comprises at least one of an upstroke acceleration time, an upstroke deceleration time, a downstroke acceleration time, a downstroke deceleration time, an upstroke time, an upper velocity parameter, and strokes per minute.

7. The system in accordance with claim 1, wherein the set of pressure weights is based on one or more additional pressure levels between the first pressure level and the second pressure level.

8. The system in accordance with claim 1, wherein said pumping control unit is further configured to:

determine a first pressure weight and a second pressure weight for the set of pressure weights based on the current pressure level;

apply the first pressure weight to the first set of stroke timing data to receive a first result;

apply the second pressure weight to the second set of stroke timing data to receive a second result; and determine the current set of stroke timing data based on the first result and the second result.

9. The system in accordance with claim 1, wherein the first set of stroke timing data and the second set of stroke timing data based on the plurality of constraints facilitate enhancing an amount of flow of fluid induced by the rod pumping unit.

10. A computer-based method for enhancing a flow of a fluid induced by a rod pumping unit, said method implemented using a pumping control unit in communication with a memory, said method comprising:

storing a first set of stroke timing data based on a first pressure level and a first gas fraction level, a second set of stroke timing data based on a second pressure level and the first gas fraction level, a third set of stroke timing data based on the first pressure level and a second gas fraction level, and a fourth set of stroke timing data based on the second pressure level and the second gas fraction level, the first set of stroke timing data, the second set of stroke timing data, the third set of stroke timing data, and the fourth set of stroke timing data is based on a plurality of constraints of the rod pumping unit;

storing a set of pressure weights based on the first set of stroke timing data, the second set of stroke timing data, and the plurality of constraints;

storing a set of gas fraction weights based on the first set of stroke timing data, the second set of stroke timing data, the third set of stroke timing data, the fourth set of stroke timing data, and the plurality of constraints;

receiving a current pressure level, wherein the current pressure level is between the first pressure level and the second pressure level;

receiving a current gas fraction level, wherein the current gas fraction level is between the first gas fraction level and the second gas fraction level;

determining a current set of stroke timing data based on the current pressure level, the first set of stroke timing data, the second set of stroke timing data, the set of pressure weights, the current gas fraction level, and the set of gas fraction weights; and initiating at least one stroke of the rod pumping unit, wherein the at least one stroke is based on the current set of stroke timing data.

11. The method in accordance with claim 10, wherein the set of gas fraction weights is based on one or more additional pressure levels between the first pressure level and the second pressure level, and is further based on one or more additional gas fraction levels between the first gas fraction level and the second gas fraction level.

12. The method in accordance with claim 10, wherein the plurality of constraints comprises one or more buckling criterion, one or more fatigue criterion, and one or more physical attributes of the rod pumping unit.

13. The method in accordance with claim 11, wherein the plurality of constraints further comprises one or more torque criterion balancing a torque applied to the rod pumping unit and one or more screw force criterion balancing a screw force applied to the rod pumping unit.

14. The method in accordance with claim 10, wherein the current stroke timing data comprises at least one of an upstroke acceleration time, an upstroke deceleration time, a downstroke acceleration time, a downstroke deceleration time, an upstroke time, an upper velocity parameter, and strokes per minute.

15. The method in accordance with claim 10, wherein the set of pressure weights based on one or more additional pressure levels between the first pressure level and the second pressure level.

16. A rod pumping unit for inducing a flow of a fluid, said rod pumping unit comprising:

a pumping control unit comprising a processor and a memory, said pumping control unit configured to control stroke movement of the rod pumping unit, thereby controlling the flow of the fluid induced by the rod pumping unit, said pumping control unit configured to:

store a first set of stroke timing data based on a first pressure level and a first gas fraction level, a second set of stroke timing data based on a second pressure level and the first gas fraction level, a third set of stroke timing data based on the first pressure level and a second gas fraction level, and a fourth set of stroke timing data based on the second pressure level and the second gas fraction level, the first set of stroke timing data, the second set of stroke timing data, the third set of stroke timing data, and the fourth set of stroke timing data is based on a plurality of constraints of the rod pumping unit;

store a set of pressure weights based on the first set of stroke timing data, the second set of stroke timing data, and the plurality of constraints;

store a set of gas fraction weights based on the first set of stroke timing data, the second set of stroke timing data, the third set of stroke timing data, the fourth set of stroke timing data, and the plurality of constraints;

receive a current pressure level, wherein the current pressure level is between the first pressure level and the second pressure level;

receive a current gas fraction level, wherein the current gas fraction level is between the first gas fraction level and the second gas fraction level;

determine a current set of stroke timing data based on the current pressure level, the first set of stroke timing data, the second set of stroke timing data, the set of pressure weights, the current gas fraction level, and the set of gas fraction weights; and initiate at least one stroke of the rod pumping unit, wherein the at least one stroke is based on the current set of stroke timing data.

17. The rod pumping unit of claim 16, wherein the set of gas fraction weights is based on one or more additional pressure levels between the first pressure level and the second pressure level, and is further based on one or more additional gas fraction levels between the first gas fraction level and the second gas fraction level.

18. The rod pumping unit of claim 16, wherein the set of pressure weights is based on one or more additional pressure levels between the first pressure level and the second pressure level.

19. The rod pumping unit of claim 16, wherein the plurality of constraints comprises one or more buckling criterion, one or more fatigue criterion, and one or more physical attributes of the rod pumping unit.

20. The rod pumping unit of claim 16, wherein the plurality of constraints further comprises one or more torque criterion balancing a torque applied to the rod pumping unit and one or more screw force criterion balancing a screw force applied to the rod pumping unit.

21. The rod pumping unit of claim 16, wherein the current stroke timing data comprises at least one of an upstroke acceleration time, an upstroke deceleration time, a downstroke acceleration time, a downstroke deceleration time, an upstroke time, an upper velocity parameter, and strokes per minute.

* * * * *